US007451556B2

(12) United States Patent
Harmon-Weiss et al.

(10) Patent No.: US 7,451,556 B2
(45) Date of Patent: Nov. 18, 2008

(54) SHOE SOLE AND CUSHION FOR A SHOE SOLE

(75) Inventors: Edith Harmon-Weiss, Swampscott, MA (US); Hans Peterson, Belmont, MA (US); Sean B. Murphy, Stoneham, MA (US); Cathleen Aron, Charlemont, MA (US); Octavio Lubrano, Hillsboro, OR (US); Ping-Chih Shih, Taichung (TW)

(73) Assignee: New Balance Athletic Shoe, Inc., Brighton, MA (US)

( * ) Notice: Subject to any disclaimer, the term of this patent is extended or adjusted under 35 U.S.C. 154(b) by 146 days.

(21) Appl. No.: 10/488,635

(22) PCT Filed: Jan. 6, 2003

(86) PCT No.: PCT/US03/00317

§ 371 (c)(1),
(2), (4) Date: Sep. 7, 2005

(87) PCT Pub. No.: WO03/056964

PCT Pub. Date: Jul. 17, 2003

(65) Prior Publication Data

US 2006/0059714 A1 Mar. 23, 2006

Related U.S. Application Data

(60) Provisional application No. 60/344,341, filed on Jan. 4, 2002.

(51) Int. Cl.
*A43B 13/18* (2006.01)

(52) U.S. Cl. ..... 36/35 B; 36/29

(58) Field of Classification Search ..... 36/35 B, 36/29, 28, 35 R

See application file for complete search history.

(56) References Cited

U.S. PATENT DOCUMENTS

| | | | | | |
|---|---|---|---|---|---|
| 4,864,738 | A * | 9/1989 | Horovitz | 36/29 |
| 4,914,836 | A * | 4/1990 | Horovitz | 36/28 |
| 5,025,575 | A * | 6/1991 | Lakic | 36/44 |
| 5,353,523 | A | 10/1994 | Kilgore et al. | |
| 5,425,184 | A | 6/1995 | Lyden et al. | |
| 5,625,964 | A | 5/1997 | Lyden et al. | |
| 5,704,137 | A * | 1/1998 | Dean et al. | 36/28 |
| 5,713,141 | A * | 2/1998 | Mitchell et al. | 36/29 |
| 5,930,918 | A | 8/1999 | Healy et al. | |
| 5,987,781 | A | 11/1999 | Pavesi et al. | |
| 6,055,746 | A | 5/2000 | Lyden et al. | |
| 6,883,253 | B2 * | 4/2005 | Smith et al. | 36/28 |
| 6,971,193 | B1 * | 12/2005 | Potter et al. | 36/141 |

* cited by examiner

*Primary Examiner*—Marie Patterson
(74) *Attorney, Agent, or Firm*—Goodwin Procter LLP

(57) ABSTRACT

The present invention relates to a cushion (20) for use in a shoe sole. The cushion (20) includes a medial chamber (26) for cushioning a medial portion of a wearer's foot, an internal chamber (40) disposed within the medial chamber (26) to increase a stiffness of the medial chamber, and at least one lateral chamber (24) for cushioning a lateral portion of the wearer's foot. The medial chamber (26) and lateral chamber (24) may be of unitary construction.

25 Claims, 9 Drawing Sheets

SHOE SOLE AND CUSHION FOR A SHOE SOLE

CROSS-REFERENCE TO RELATED APPLICATIONS

This application is a national stage application of international PCT application Ser. No. PCT/US03/00317 filed under 35 U.S.C. §371 on Jan. 6, 2003 and published on Jul. 17, 2003 as International Publication No. WO 03/056964, and claims priority under 35 U.S.C. §363 and 35 U.S.C. §119 to U.S. provisional patent application Ser. No. 60/344,341, filed on Jan. 4, 2002, each of which is incorporated in its entirety herein by reference thereto.

FIELD OF THE INVENTION

The present invention relates to a cushion for use in a shoe sole for cushioning and supporting a foot. More particularly, the invention relates to a cushion that has at least one chamber that encloses an inner chamber for cushioning a region of a foot.

BACKGROUND OF THE INVENTION

Athletic shoe soles have been made with a variety of resilient cushioning elements for cushioning a wearer's feet, such as by storing and absorbing impact energy. Known cushioning elements include bladders enclosing material that is pressurized, such as to a pressure greater than the ambient pressure surrounding the cushioning element. Typical materials include gases, viscous liquids, and gels. The cushioning properties of these known shoe soles depend upon retaining the pressurized state of the enclosed material.

A cushion element for a shoe sole would ideally provide cushioning properties that vary as a function of position. For example, a cushion providing a stiffness that is greater along a medial edge relative to a lateral edge would tend to reduce pronation compared to a cushion lacking such differential stiffness.

SUMMARY OF THE INVENTION

The present invention relates to a cushion that includes at least one chamber enclosing an internal element. A chamber is an element having a surface that encloses a volume, such as a hollow volume containing a gas or fluid. The internal element is preferably a blow molded chamber that increases the vertical stiffness and spring of the enclosing chamber. The chamber that encloses the internal chamber may be referred to as a medial chamber because it is preferably disposed along a medial portion of the cushion. When the cushion is disposed in a shoe sole, the enclosing chamber preferably extends from a position adjacent the medial heel portion of the shoe sole to a location adjacent the medial forefoot portion of the shoe sole.

The medial chamber and internal element have a strength and stiffness sufficient to support the medial (inner) edge portion of a wearer's foot even in the absence of any fluid trapped therein. Thus, the cushioning properties of the medial chamber and internal element are preferably substantially independent of the pressure or compressibility of any fluid or other material present therein.

In addition to the medial chamber, the cushion preferably includes at least one lateral cushion and one rear cushion. When the cushion is disposed in a shoe sole, the lateral cushion supports and cushions a lateral (outer) edge portion of a wearer's foot. The rear cushion supports and cushions the rear of a wearer's foot, such as the back of the heel.

The lateral and rear cushions preferably enclose a fluid, which may flow between these cushions by a tube or other passage therebetween. The cushioning properties of the lateral and rear cushions may vary during a heel strike as compression by a wearer's foot causes fluid to flow from the rear chamber to the lateral chamber. The fluid is preferably a gas, such as air. Prior to heel strike, any fluid trapped within the lateral and rear chambers is preferably not pressurized to a pressure greater than the ambient pressure surrounding the cushion.

BRIEF DESCRIPTION OF THE DRAWINGS

The present invention is discussed below in relation to the drawings in which.

DETAILED DESCRIPTION OF THE PREFERRED EMBODIMENT

Figure 1:
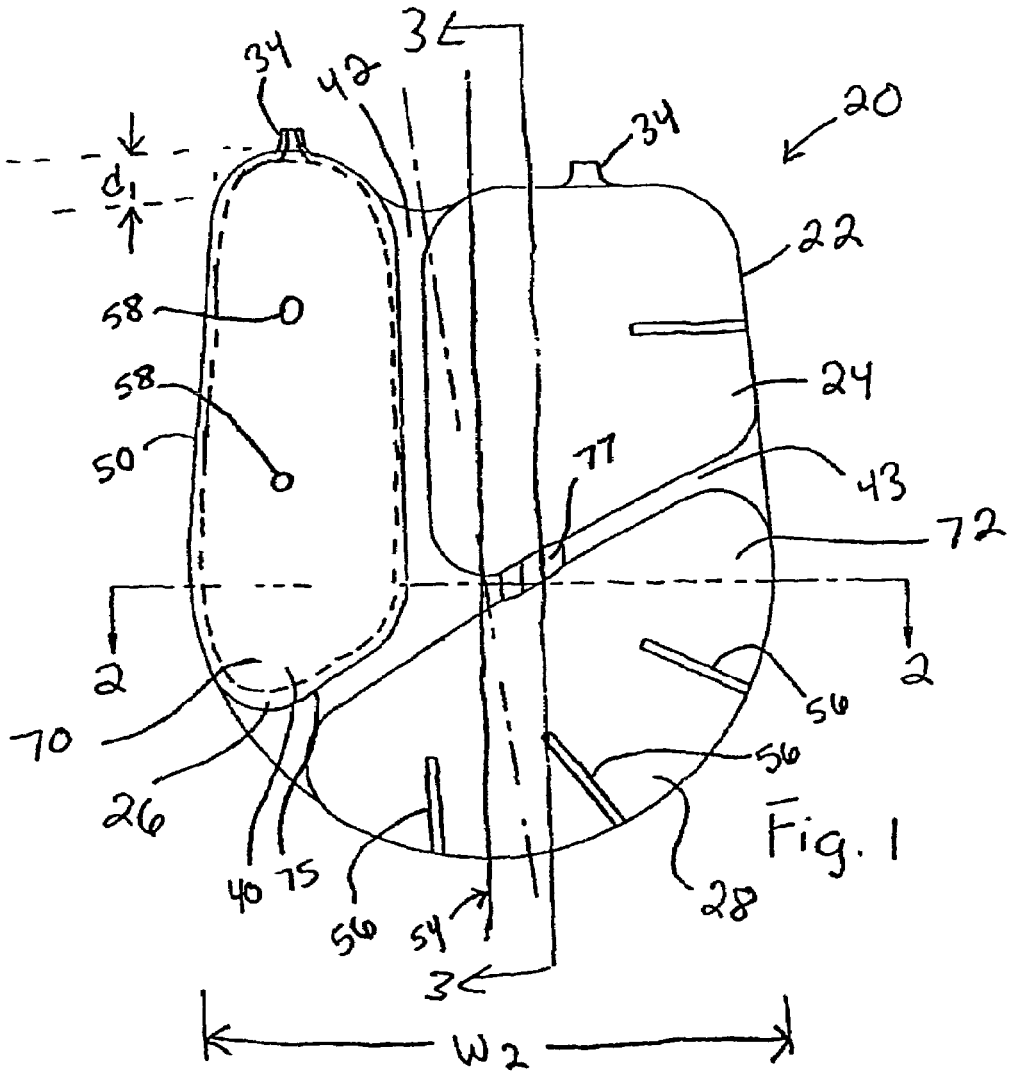
FIG. 1 shows a bottom view of a cushion of the invention.
Figure 2:
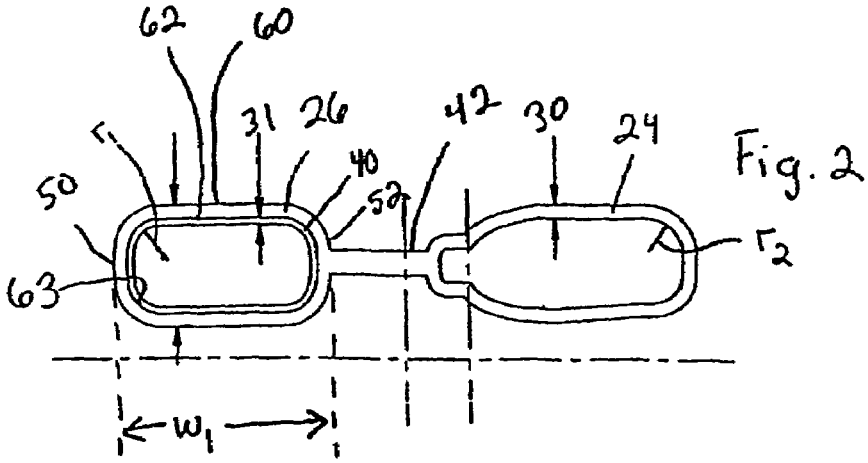
FIG. 2 shows a cross sectional view of the cushion of FIG. 1.

Referring to FIGS. 1 and 2, a cushion 20 includes an outer cushion 22, which preferably includes a lateral chamber 24, a medial chamber 26 and a rear chamber 28. Chambers 24, 26, 28 may contain a fluid, such as a gas, which, in the resting state, is preferably not pressurized to a pressure greater than the ambient pressure surrounding cushion 22 during use. Preferably, the strength of the chambers is sufficient for supporting and cushioning the wearer's foot irrespective of any material contained therein. It should be understood, however, that one or more of the chambers may include a fluid that cooperates with the chamber to support and cushion a wearer's foot. For example, a chamber may enclose a gas that increases in pressure during a heel strike to provide further cushioning to a wearer's foot.

Cushion 20 is preferably disposed in shoe sole formed of conventional materials. For example, the sole may include a main sole formed of ethyl vinyl acetate (EVA) and an outsole formed from a material such as rubber. Suitable soles and sole constructions for use with cushion 20 is discussed in U.S. Pat. No. 6,026,593, which is incorporated by reference herein. In a preferred embodiment, cushion 20 is disposed within a sole to cushion a wearer's heel.

The footprint of the cushion 20 is preferably asymmetric. The medial chamber 26 preferably extends a distance $d_1$ further toward the front of the cushion (i.e., the front of the shoe when placed in a sole) than the lateral chamber. The asymmetry enhances the ability of cushion 20 to reduce the tendency of a wearer's foot to pronate.

The width $w_1$ of the medial chamber is defined by the outer medial edge 50 of the cushion 20 and an inner medial edge 52 that runs substantially parallel with the outer medial edge parallel to the major longitudinal axis 54 of the cushion. The width of the medial chamber is preferably less than about 40% of the total width $w_2$ of the cushion 20. When the cushion 20 is disposed in the sole of a shoe, the medial chamber preferably extends from a point adjacent the heel to the forefoot of the shoe. The medial chamber preferably has a width to height aspect ratio of between about 2 and about 4.

The medial and lateral chambers are preferably spaced apart by a web 42, which allows the medial and lateral chambers to compress independently of one another. Web 42 also allows cushion 20 to flex about a longitudinal axis of web 42. The rear chamber is spaced apart from the medial and lateral chambers by a web 43, which allows the rear chamber to compress independently of the medial and lateral chambers. Web 43 also spaces a rear portion 75 of medial chamber 26 apart from chamber 28.

Medial chamber 26 encloses an internal element 40, which is preferably a blow molded chamber. Internal element 40 and medial chamber 26 cooperate to make the medial portion of cushion 20 stiffer than the lateral chambers for stabilizing the wearer's foot to thereby prevent the wearer's foot from overpronating towards the lateral direction. The stiffness of the medial chamber with internal element is preferably at least about 10% greater, such as about 25% greater, than the stiffness of the lateral chamber.

The medial chamber and internal element stiffness can be modified by, for example, changing the radii $r_1$ of the chamber walls adjoining the top and bottom surfaces. For example, decreasing the radii increases the stiffness of the medial chamber or internal element. Increasing the footprint of the medial chamber relative to the surface area of the upper surface of the chamber also increases the stiffness of the chamber.

Other approaches for modifying the stiffness of a chamber include adding ribs 56 to the surfaces of the chamber, adding pinch/locator pin marks 58 and increasing the stiffness of the internal component. The marks 58 may be used to prevent the internal chamber from moving within the medial chamber. In this case, the marks 58 are formed as depressions extending from an outer surface 60 of medial chamber to an outer surface 62 of inner element 40.

The shape and construction of the lateral chambers and any internal elements therein are selected in order to make these chambers more compliant than the combined medial chamber/internal element for cushioning the wearer's foot. For example, the lateral chambers are preferably formed without an internal element or formed with an internal element that is more compliant than that used within the medial chamber. Additionally, the radii $r_2$ adjoining the walls and top surface may be greater than the corresponding radii of the medial chamber. The lateral chambers may be shaped with a relatively smaller footprint to top surface ratio than the medial chamber.

The lateral chambers may be fluidly connected such as by a tube 77 to allow fluid to flow between the lateral chambers during heel strike. As fluid flows from one chamber to another during heel strike, the cushioning properties of the chamber receiving the fluid increase. The cushioning properties of the medial chamber, however, are preferably independent of the cushioning properties of the lateral chambers. Thus, the medial chamber is preferably not fluidly connected with the lateral chambers.

Outer surface 62 of internal element 40 preferably corresponds substantially in shape to and is of a similar size as an internal surface 63 of medial chamber 26. Where the external surface of the internal element is of a smaller size or different shape than the internal surface of the medial chamber, the inner surfaces, preferably the top and bottom inner surfaces, of the medial chamber may contain one or more locator cavities to position the inner cushioning element therein. The outer surface of the inner cushioning element may contain one or more protrusions of complementary shape to the locator cavities. Of course, the inner surface of the medial chamber may be provided with protrusions complementary to cavities of the outer surface of the inner cushioning element.

Figure 3:
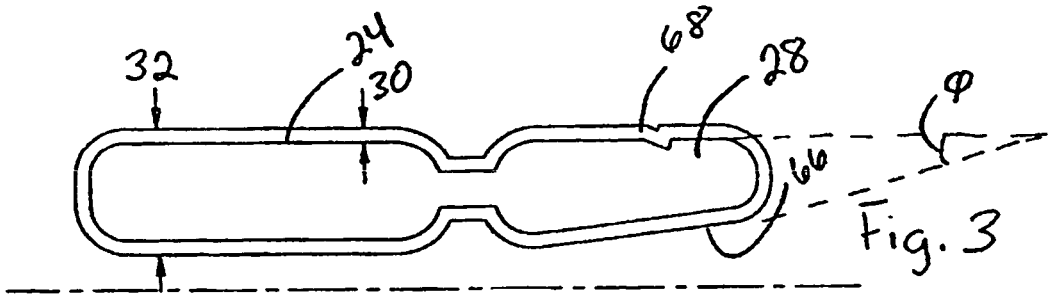
FIG. 3 shows a second cross sectional view of the cushion of FIG. 1.
Figure 4:
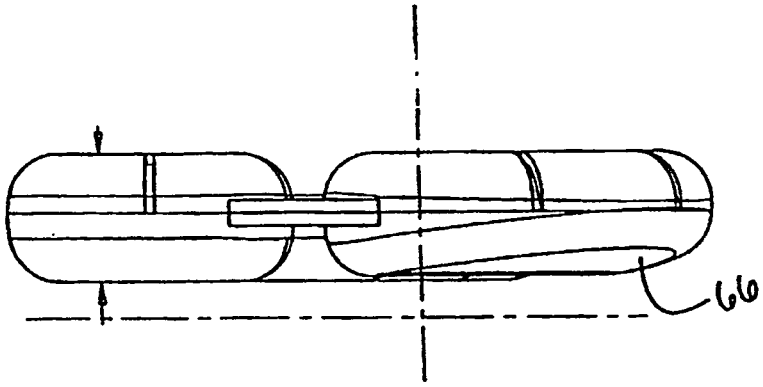
FIG. 4 shows a lateral side view of the cushion of FIG. 1.

Referring to FIGS. 3 and 4, the bottom surface 66 of the rear chamber is preferably formed at an angle $\phi$ to the upper surface 68 of the rear chamber 28 thereby creating a beveled surface. Angle $\phi$ is between about 3 and 15 degrees, such as between about 6 and 10 degrees. Preferably the distance between the top and bottom surfaces of the rear chamber increases moving from the rear of the cushion towards the front of the cushion so that the bottom surface slopes up from the horizontal to meet the top surface.

The rear chamber is disposed at an angle from the centerline of cushion 20 and is separated from the nearest lateral and medial chambers in order to form a heel cleft, which follows web 43. The angle from centerline is about 20 to 45 degrees, such as about 30 to 40 degrees. During heel strike, cushion 20 flexes along the heel cleft reducing tendency of the shoe to roll excessively to one side. Following a heel strike, the heel cleft reduces the rate of pronation to reduce the amount of pronation that occurs between heel strike and when the forefoot contacts a surface.

In one embodiment of the invention, an outsole is adhered directly to lower surfaces of chambers 24, 26, and 28 leaving webs 42 and 43 exposed. Leaving the webs exposed allows the completed shoe sole to retain more of the cushion's flexibility along webs 42 and 43.

Figure 5:
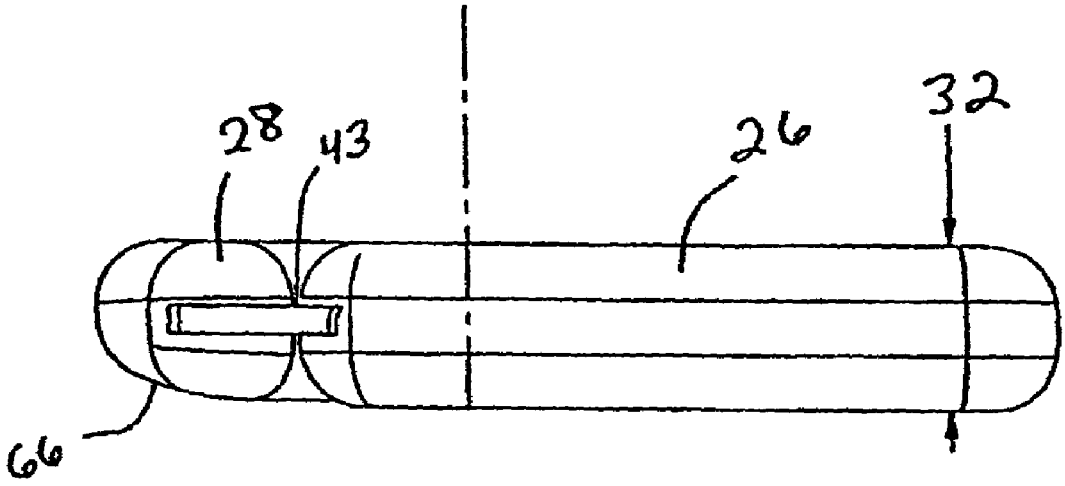
FIG. 5 shows a medial side view of the cushion of FIG. 1.

Referring to FIGS. 1, 4, and 5, the walls of the outer cushion 22 may have ribs 56 extending partially or substantially fully widthwise thereacross. The ribs are configured and dimensioned for increasing wall stiffness. For example, the ribs may extend across the top and bottom surfaces of the component to increase the stiffness of the component.

Outer cushion 22 is preferably blow molded in a single piece of unitary construction. As understood in the art, blowmolding may include extrusion of a material resin through a die and mandrel, injection of air through the resin, followed by closure of the mold, cooling and release of the molded element.

Inner element 40 is also preferably blow molded but may also be formed by a different process than the outer cushion 22.

Outer cushion 22 is preferably formed of a material having a lower modulus than the material forming inner element 40. The material forming the outer cushion preferably provides dampening properties to cushion 20. For example, preferred materials for the outer cushion 22 include thermoplastics such as urethane (and blends), PVC (and blends), polyester and polyester-polyether glycol blends, ethylene vinyl acetate and polyether.

The material forming the inner element 40 preferably imparts stiffness and spring properties to cushion 20. Preferred materials for use in the construction of inner element 40 of cushion 20 include, for example, polyester elastomers such as HYTREL HTR5612 or HTX8382, urethane (and blends), PVC (and blends), polyester and polyester-polyether glycol blends, ethylene vinyl acetate and polyether. The HYTREL elastomers designed for blow molding and sold by Dupont. The inner element 40 may also be formed, for example, of a foam, such as a closed cell foam to provide a light weight dampener.

Preferred elastomeric materials for forming inner element 40 have relatively high melt viscosities. The most preferred inner element material preferably has a Poisson's ratio of about 0.45, a flexural modulus of between about 100 and about 150 MPa, for example 124 MPa, and a hardness durometer of between about 40 and 60, for example 50 on the D scale. When subjected to a compression test in which the material is compressed to 50% of its original thickness for 48 hours and then released, the material preferably decompresses substantially completely. The preferred configuration returns to within 1% of its original thickness after a compression test.

Using the preferred materials, the preferred thickness 30 of the walls of the outer cushion 22 is between about 1.0 to 2.5 mm, such as about 1.4 mm to 2.4 mm to support and cushion the heel together with the remainder of the sole without collapsing. The thickness 31 of the walls of the internal element 40 is preferably between about 0.5 to 2.2 mm, such as about 0.75 to 1.5 mm. These thickness can be decreased or increased depending on the activity for which the shoe is built. The thickness may also be varied in from chamber to chamber to localize variations in stiffness. For example, the thickness may be reduced when the surface geometry of the chambers is modified, such as by adding ribs, to increase the chamber strength compared to an unmodified chamber. The preferred height 32 of the outer cushion is between about 60% and 95% of the height of the sole at the cushion, and most preferably between about 80% and 85%.

As a result of the preferred blow molding process, stubs 34 may remain through which air was blown during manufacturing. These stubs may be sealed to prevent the cushion 20 from emitting an annoying noise each time a step is taken, as air is sucked in and blown out through the stub. Sealing the stubs 34 also prevents water, or other fluids that may be present on a walking surface from entering the cushion 20. If the stubs 34 themselves are not closed, material adjacent the cushion 20 in the sole may be used to obstruct the stub openings. As mentioned above, although the cushion 20 may trap air once the stubs 34 are obstructed, the walls of the cushion 20 provide the main support and cushioning for a foot, instead of the trapped air or other fluid.

In addition to blow-molding, other conventional molding processes, such as vacuum molding, extrusion, and injection molding may be used to form the cushion of the invention. When vacuum molding a cushion, 1 or 2 bed systems may be used. In a 1 bed system opposing surfaces of the cushion are separately formed and joined, such as by RF welding. In a 2 bed system, first and second molds are used to form and join opposing surfaces of the cushion. Each inner bladder component may be formed with a different manufacturing process and/or material. For example, inner elements disposed within the lateral chambers may be formed to have a lower stiffness than inner element 40 of the medial chamber.

Figure 6:
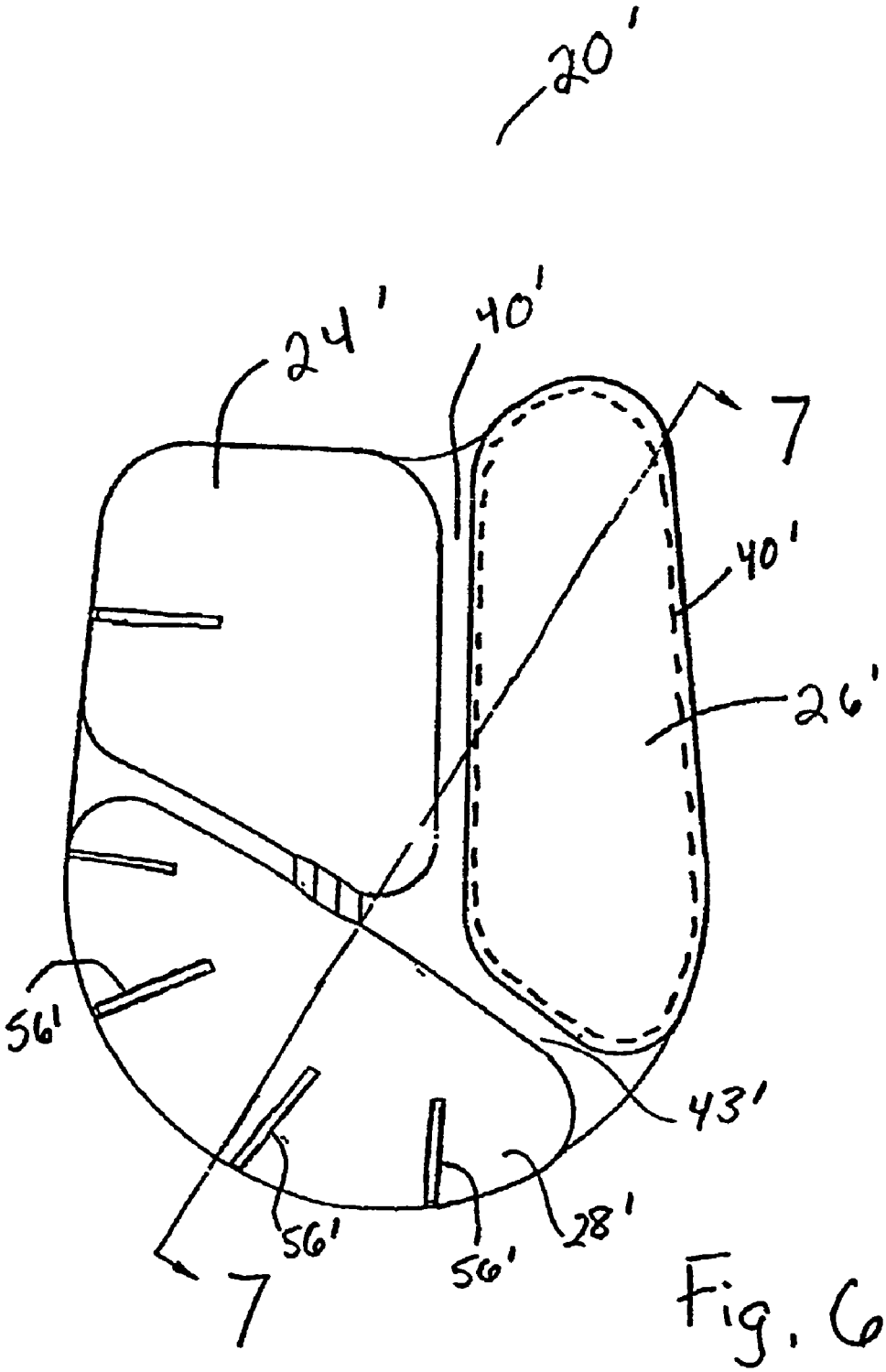
FIG. 6 shows a bottom view of a second embodiment of a cushion according to the invention.
Figure 7:
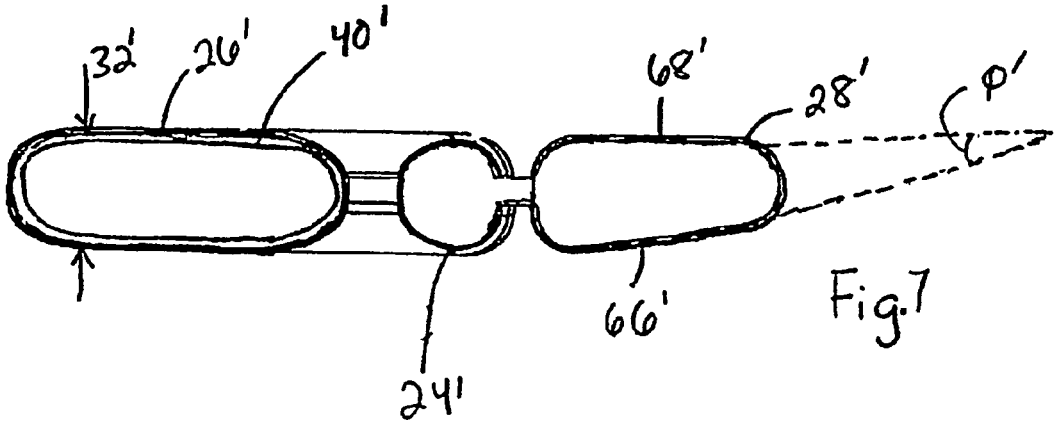
FIG. 7 shows a cross sectional view of the cushion of FIG. 6.
Figure 8:
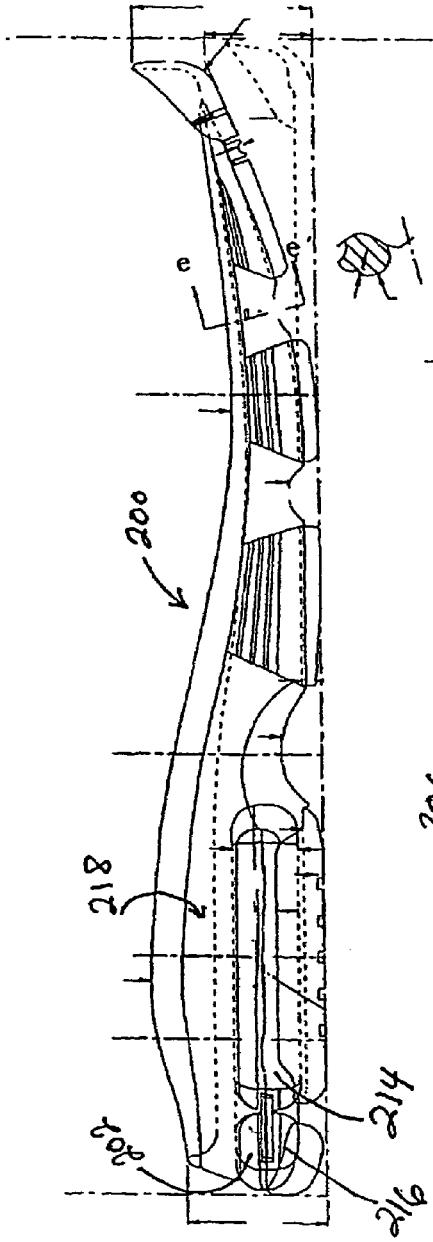
FIG. 8 shows a medial side view of a shoe sole and cushion of the invention.
Figure 9:
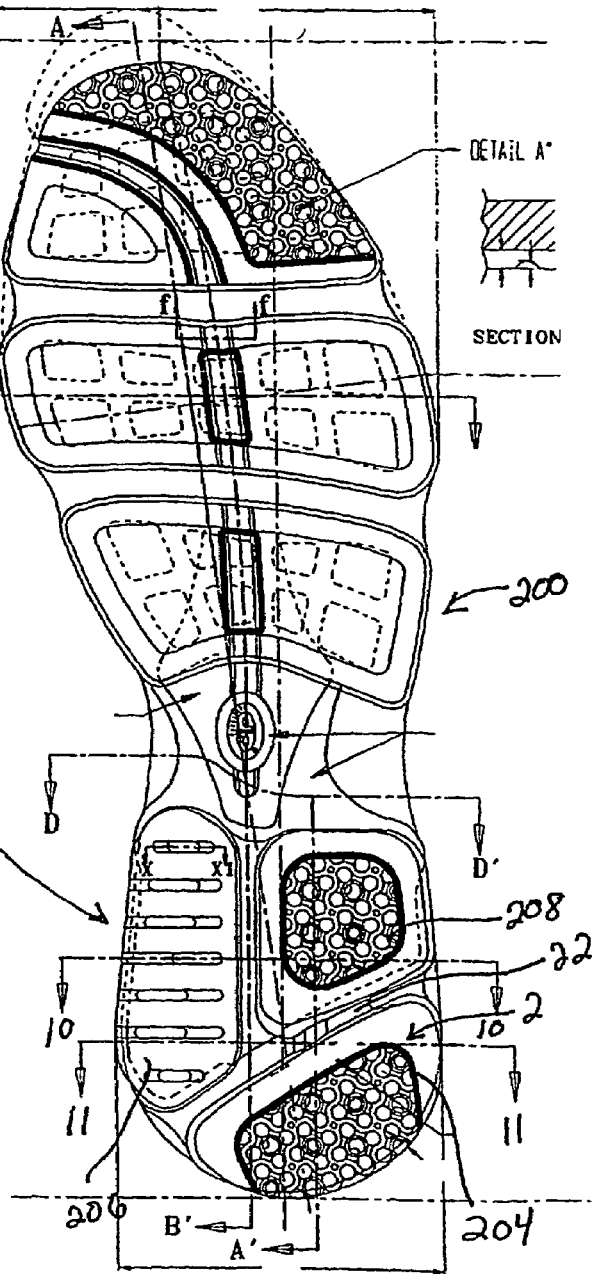
FIG. 9 shows a bottom view of the sole of FIG. 8.
Figure 10:
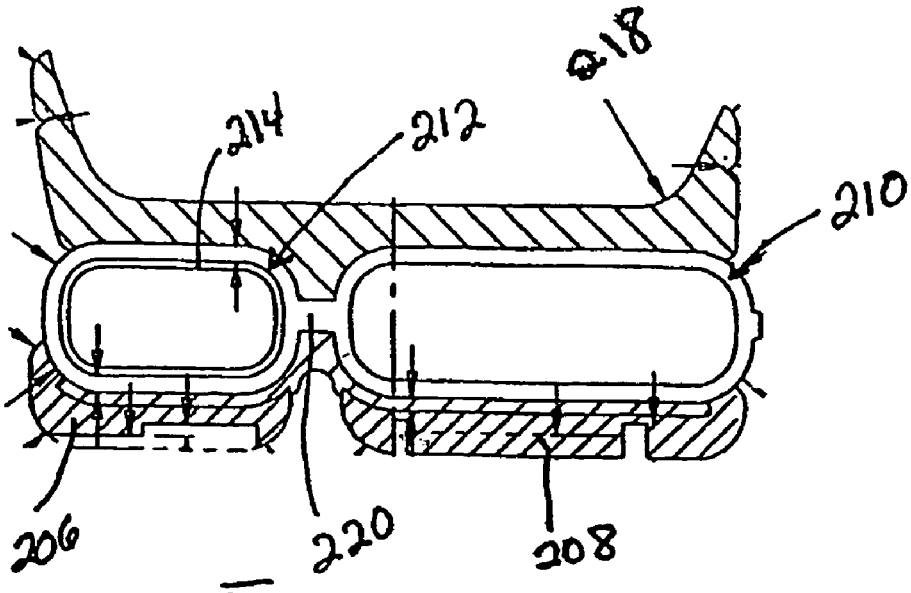
FIGS. 10 and 11 show cross sectional views of the shoe sole of FIG. 9.

Referring to FIGS. 6 and 7 a cushion 20' lacks the pin marks of cushion 20 but is otherwise the same. Cushion 20' includes a lateral chamber 24', a rear chamber 28' and a medial chamber 26'. Ribs 56' add stiffness to lateral and rear chambers 24', 28'. Reference characters with primes refer to the same characters without primes as discussed above.

Referring to FIGS. 8-11, a shoe sole 200 includes a cushion 202. A heel portion 201 of sole 200 includes a rear outsole 204 associated with a rear chamber 216, a medial outsole 206 associated with a medial chamber 212, and a lateral outsole associated with a lateral chamber 210. Each outsole may be affixed to its respective chamber, such as by adhesive. Sole 200 also includes a midsole 218, which can be formed of, for example, EVA.

Medial chamber 212 includes an inner cushioning element, which is an inner chamber 214, such as a blow molded inner chamber, as discussed above.

Chambers 210 and 212 move, such as by flexing, with respect to one another about a web 220. Rear chamber 216 moves with respect to chambers 210 and 212 about a web 222, which forms a heel cleft as discussed above.

Figure 11:
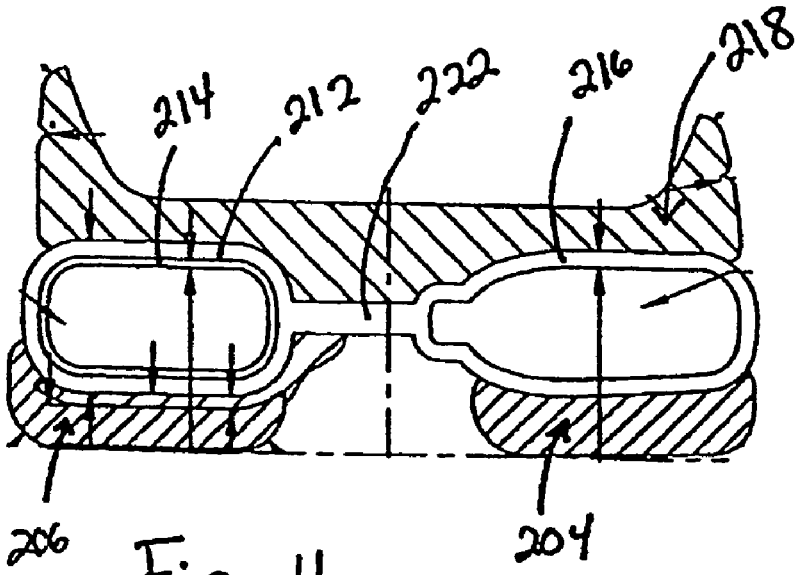
Figure 14:
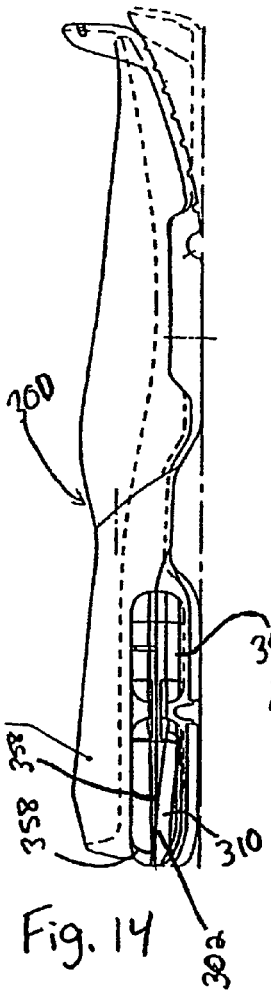
FIG. 14 shows a lateral view of the shoe sole and cushion of FIG. 12.
Figure 12:
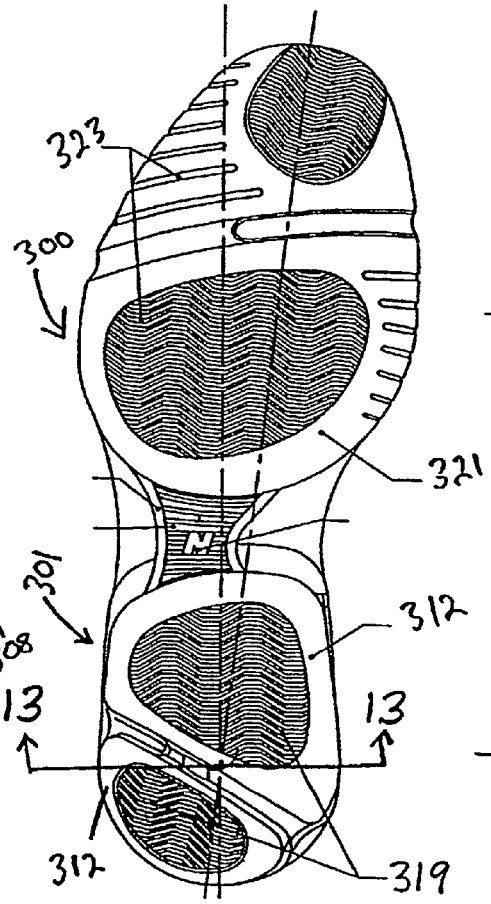
FIG. 12 shows a bottom view of second shoe sole and cushion of the invention.
Figure 15:
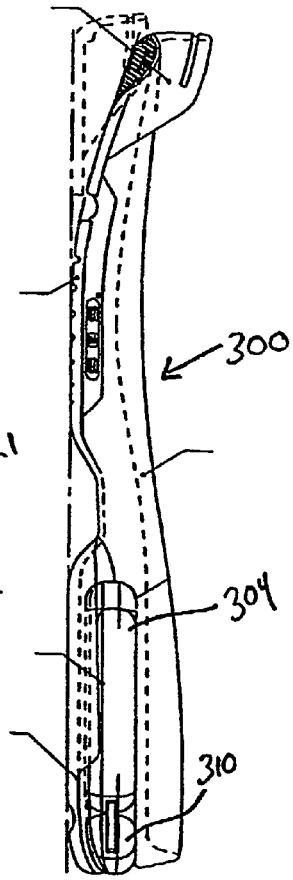
FIG. 15 shows a medial view of the shoe sole and cushion of FIG. 12.
Figure 13:
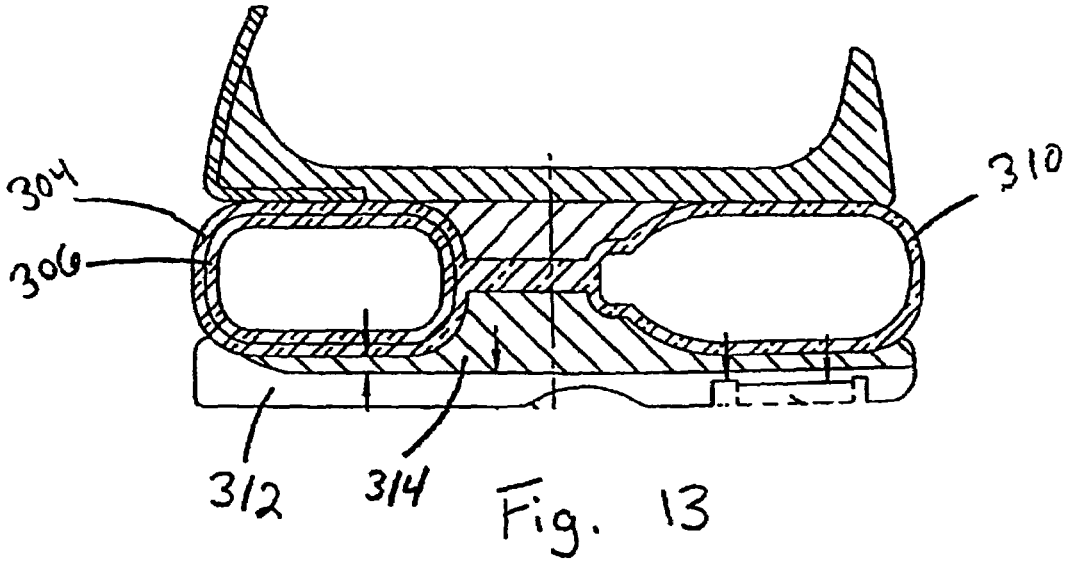
FIG. 13 shows a cross sectional view of the shoe sole and cushion of FIG. 12.

At least a portion of cushion 202 may be exposed, that is not covered by an outsole portion, as seen in FIG. 11. The outsole may be applied to bottom surfaces of the chambers of cushion 202 without an intervening portion of midsole thereby leaving web portions of cushion 202 substantially exposed.

Referring to FIGS. 12-15, a heel portion 301 of a sole 300 includes a cushion 302. Cushion 302 includes a medial chamber 304 with an inner cushioning element 306, a lateral chamber 308, and a rear chamber 310.

Heel portion 301 includes an outsole 312, which may be spaced apart from cushion 302 by a midsole 314. Portions 319 of outsole 312 may contain geometric features, such as herringbone features, to facilitate traction. A forefoot portion of sole 300 contains an outsole 321, which may also contain portions 323 with geometric features.

It should be understood that a cushion of the invention may be placed in the forefoot of a shoe in order to provide cushioning, for example, to the materials and phalanges of the foot. The forefoot chambers may be divided into medial and lateral zones and extend along the lateral and medial sides of the forefoot of the wearer's foot. Each chamber may include an internal chamber to regulate the component's stability and cushioning characteristics. The height to width ratio of the forefoot cushion chambers is preferably smaller than the corresponding ratio of the medial chamber of cushion 20.

While the above invention has been described with reference to certain preferred embodiments, it should be kept in mind that the scope of the present invention is not limited to these. Thus, one skilled in the art may find variations of these preferred embodiments which, nevertheless, fall within the spirit of the present invention, whose scope is defined by the claims set forth below.

What is claimed is:

1. A cushion for use in a shoe sole, comprising:

a medial chamber for cushioning a medial portion of a wearer's foot;

an internal chamber disposed within the medial chamber and cooperating with the medial chamber to increase a stiffness of the medial chamber relative to the at least one lateral chamber, an outer surface of the internal chamber aligned along an inner surface of the medial chamber to follow the shape thereof; and at least one lateral chamber for cushioning a lateral portion of the wearer's foot, wherein the at least one lateral chamber is fluidly disconnected from the medial chamber so that the medial chamber and the at least one lateral chamber are compressible independently from each other.

2. The cushion of claim 1, wherein the medial chamber and the at least one lateral chamber are of unitary construction.

3. The cushion of claim 2, wherein the medial and the at least one lateral chamber are blow molded.

4. The cushion of claim 1, wherein the inner chamber is formed of a material having a stiffness higher than a stiffness of a material forming the medial and the at least one lateral chamber.

5. The cushion of claim 1, wherein the inner chamber is blow molded.

6. A shoe sole comprising the cushion of claim 1.

7. The cushion of claim 1, wherein the medial and the at least one lateral chamber are spaced apart by a web, and wherein the web is arranged along a longitudinal axis of the shoe sole so that the cushion flexes about the longitudinal web.

8. The cushion of claim 1, wherein the medial chamber and the internal chamber are formed of a material having a stiffness and strength sufficient to support the medial edge of a wearer's foot.

9. The cushion of claim 1, wherein the stiffness of the medial chamber is larger than that of the at least one lateral chamber.

10. The cushion of claim 9, wherein the stiffness of the medial chamber cooperating with the internal chamber is at least 10% greater than that of the at least one lateral chamber.

11. The cushion of claim 9, wherein the stiffness of the medial chamber cooperating with the internal chamber is at least 25% greater than that of the at least one lateral chamber.

12. The cushion of claim 1, wherein the medial chamber comprises a material having a lower modulus than a material forming the internal chamber.

13. The cushion of claim 1, wherein the medial chamber comprises at least one of thermoplastics including urethane and blends thereof, PVC and blends thereof, polyester and polyester-polyether glycol blends, ethylene vinyl acetate and polyether.

14. The cushion of claim 1, wherein the internal chamber comprises at least one of a polyester elastomer including HYTREL, HTR5612 and HTX8382, urethane and blends thereof, PVC and blends thereof, polyester and polyester-polyether glycol blends, ethylene vinyl acetate, polyether, and a closed cell foam.

15. The cushion of claim 1, wherein a thickness of each wall of the medial chamber and of the at least one lateral chamber is greater than or equal to 1.0 mm and less than or equal to 2.5 mm.

16. The cushion of claim 1, wherein the at least one lateral chamber comprises two or more lateral chambers in fluid connection with one another.

17. The cushion of claim 1, further comprising a rear chamber, the rear chamber fluidly disconnected from the medial chamber and the at least one lateral chamber so that the rear chamber is independently compressible from the medial chamber and the at least one lateral chamber.

18. The cushion of claim 17, wherein the rear chamber is spaced apart from the medial chamber and at least one lateral chamber by a flexible web.

19. The cushion of claim 18, wherein the rear chamber and the flexible web are disposed at an angle from a centerline of the cushion, wherein the flexible web forms a heel cleft.

20. The cushion of claim 19, wherein the angle is between 20 degrees and 45 degrees inclusive.

21. The cushion of claim 20, wherein the medial chamber extends further toward a forefoot of the shoe sole than the at least one lateral chamber so that the cushion has an asymmetric footprint, thereby reducing the tendency of a wearer's foot to pronate.

22. The cushion of claim 1, wherein the medial chamber extends further toward a forefoot of the shoe sole than the at least one lateral chamber so that the cushion has an asymmetric footprint thereby reducing the tendency of a wearer's foot to pronate.

23. The cushion of claim 1, wherein one of the at least one lateral chamber comprises an internal element that is more compliant than the internal chamber disposed within the medial chamber.

24. The cushion of claim 1, wherein at least one of the medial chamber and the at least one lateral chamber comprises ribs positioned on a surface thereof, the ribs adapted to stiffen the respective chamber.

25. The cushion of claim 1, the internal chamber comprising an outer surface having stiffening ribs and the medial chamber comprising locator marks for holding the internal chamber in a predetermined position within the medial chamber, wherein the marks are formed as depressions extending from an outer surface of the medial chamber to an outer surface of the inner chamber, and are of complementary shape and positioning relative to the ribs.

* * * * *